US010591158B2

(12) United States Patent
VanCleave, III et al.

(10) Patent No.: US 10,591,158 B2
(45) Date of Patent: Mar. 17, 2020

(54) TORCH HAVING AN INTERLOCK MECHANISM

(71) Applicant: Worthington Torch LLC, Columbus, OH (US)

(72) Inventors: Walter G. VanCleave, III, Pickerington, OH (US); Jared D. Crooks, Powell, OH (US); Bortman T. Jung, Powell, OH (US); Shea Michael Stewart, Wichita, KS (US)

(73) Assignee: WORTHINGTON TORCH LLC, Columbus, OH (US)

( * ) Notice: Subject to any disclaimer, the term of this patent is extended or adjusted under 35 U.S.C. 154(b) by 187 days.

(21) Appl. No.: 15/971,377

(22) Filed: May 4, 2018

(65) Prior Publication Data

US 2018/0320896 A1 Nov. 8, 2018

Related U.S. Application Data

(60) Provisional application No. 62/502,927, filed on May 8, 2017.

(51) Int. Cl.
*F23D 14/28* (2006.01)
*F23D 14/46* (2006.01)
(Continued)

(52) U.S. Cl.
CPC ..... *F23D 14/465* (2013.01); *F23D 14/28* (2013.01); *F23D 14/38* (2013.01); *F23Q 2/164* (2013.01);
(Continued)

(58) Field of Classification Search
CPC ..... F23Q 2/164; F23Q 2/287; F23D 14/28; F23D 14/38; F23D 14/465; F23D 2209/00
See application file for complete search history.

(56) References Cited

U.S. PATENT DOCUMENTS 5,199,865 A 4/1993 Liang
5,934,895 A 8/1999 McDonough et al.
(Continued)

FOREIGN PATENT DOCUMENTS

EP 1439348 7/2004

OTHER PUBLICATIONS

International Preliminary Report on Patentability for corresponding Intl. Appl. No. PCT/US2018/031086 dated Nov. 21, 2019; and Written Opinion of the Intl. Searching Authority dated Aug. 30, 2018.

(Continued)

*Primary Examiner* — Alfred Basichas

(74) *Attorney, Agent, or Firm* — Tucker Ellis LLP; Carlos Garritano

(57) ABSTRACT

A torch device having a pivoting torch arm, including a fuel delivery system having a fuel tank and microjet burners positioned in the end of the torch arm, and an ignition system including an ignition button and a piezoelectric igniter for igniting fuel, and an interlock mechanism including a mounting tab pivotally attaching the torch arm to the body of the torch, with a guide pocket defined by a laterally-extending wall of the mounting tab, and a rocker arm having a distal arm cooperating with and confined within the guide pocket, and a proximal arm cooperating with the ignition button, and configured to prevent a user from pressing the ignition button based on the angular position of the torch arm relative to the torch body.

8 Claims, 7 Drawing Sheets

(51) Int. Cl.

| | |
|---|---|
| ***F23Q 2/28*** | (2006.01) |
| ***F23D 14/38*** | (2006.01) |
| ***F23Q 2/16*** | (2006.01) |

(52) U.S. Cl.
CPC ..... *F23Q 2/287* (2013.01); *F23D 2209/00* (2013.01)

(56) References Cited

U.S. PATENT DOCUMENTS

| | | | |
|---|---|---|---|
| 6,152,725 | A | 11/2000 | Lee |
| 6,592,362 | B2 | 7/2003 | Fisher |
| 6,648,630 | B2 | 11/2003 | Tse |
| 6,827,572 | B2 | 12/2004 | Wong |
| 6,997,702 | B1 | 2/2006 | Chen |
| 7,563,094 | B2 | 7/2009 | Yang |
| 7,614,874 | B2 | 11/2009 | Mochizuki et al. |
| 7,637,736 | B1 | 12/2009 | Yang |
| 7,682,148 | B2 | 3/2010 | Mochizuki et al. |
| 7,748,977 | B2 | 7/2010 | Mochizuki et al. |
| 8,449,291 | B2 | 5/2013 | Tsai |
| 2006/0073431 | A1 | 4/2006 | Brown |
| 2007/0160945 | A1* | 7/2007 | Lin ..... F23Q 2/287 431/344 |
| 2008/0070173 | A1 | 3/2008 | Sgroi et al. |
| 2008/0220385 | A1 | 9/2008 | Mochizuki et al. |
| 2016/0018108 | A1 | 1/2016 | Rahbar |

OTHER PUBLICATIONS

"SCRIPTO® Folding Utility Lighter", from Calico Brands, Inc., product advertisement published online prior to Jul. 8, 2016, downloaded from www.calicobrands.com/folding-utiltiy-lighter, (2 pages).

"Luminere Candle Lighter" from BIC Corp., product advertisement published online prior to Jul. 8, 2016, downloaded from www.amazon.com/bic-luminere-candle-lighter-position, (1 page).

"Tactical" from Scorch Torch Premium Lighters, product advertisement published online prior to Jul. 8, 2016, downloaded from www.scorchtorch.com/tactical, (1 page).

International Search Report dated Aug. 30, 2018 by the Korean Intellectual Property Office for corresponding International Application No. PCT/US2018/031086 filed May 4, 2018 (8 pages).

Written Opinion dated Aug. 30, 2018 by the Korean Intellectual Property Office for corresponding International Application No. PCT/US2018/031086 filed May 4, 2018 (9 pages).

* cited by examiner

TORCH HAVING AN INTERLOCK MECHANISM

CROSS-REFERENCE TO RELATED APPLICATIONS

This application claims the benefit of U.S. Provisional Application No. 62/502,927, filed May 8, 2017, the disclosure of which is incorporated herein by reference in its entirety.

TECHNICAL FIELD

The invention relates to portable fuel torches.

BACKGROUND OF THE INVENTION

Known hand-held, gas-burning devices include those that incorporate child-safety features to at least inhibit inadvertent ignition of the gas-burning device, for example, by a child. Known lighters include those having an upper cap, or cover, which can be "flipped" open to use the lighter, but does not automatically return to the non-use, closed position.

Known devices further include a particular type with a lock lever that squeezes a gas pipe to cut the gas supply and quench the device. Such devices are particularly difficult to operate because the lock lever must be pressed and held while another lever must be pressed to ignite a piezoelectric unit which ultimately lights the device.

SUMMARY OF THE INVENTION

The present invention provides a torch device having a body and including: a fuel delivery system including a fuel tank including a fuel discharge valve, one or more microjet burners, a fuel hose placing the fuel discharge valve in fluid communication with the one or more microjet burners, and flow actuator lever movable between a first position, and a second position at which fuel discharge valve is opened; an ignition system including an ignition button, a piezoelectric igniter, and an ignition wire, the ignition button configured to move between an raised, undepressed position to a second depressed position at which the ignition button mechanically engages and energizes the piezoelectric igniter and to emit a spark at the ignition wire, and wherein the flow actuator lever in the first position biases the ignition button to its raised, undepressed position; a torch arm having a distal end housing the piezoelectric igniter and the one or more microjet burners, and having a proximal end including a mounting tab having a planar wall defining a pocket, the mounting tab pivotally attaching the torch arm to the torch body; and an interlock mechanism as described herein that comprises a rocker arm and the pocket, wherein the pocket and the rocker arm cooperate to prevent a user from pressing the ignition button based on the angular position of the torch arm relative to the torch body.

Another embodiment of the invention provides a torch device having a pivoting torch arm, including a fuel delivery system having a fuel tank and microjet burners positioned in the end of the torch arm, and an ignition system including an ignition button and a piezoelectric igniter for igniting fuel, and an interlock mechanism including a mounting tab pivotally attaching the torch arm to the body of the torch, with a guide pocket defined by a laterally-extending wall of the mounting tab, and a rocker arm having a distal arm cooperating with and confined within the guide pocket, and a proximal arm cooperating with the ignition button, and configured to prevent a user from pressing the ignition button based on the angular position of the torch arm relative to the torch body.

BRIEF DESCRIPTION OF THE DRAWINGS

Various embodiments of a torch will become better understood with regards to the following description, appended claims and accompanying drawings.

DETAILED DESCRIPTION OF THE INVENTION

In one application, a torch can be advantageously used by campers to start campfires, and for a variety of other uses and activities. The torch can provide more robust combustion power in a durable, compact form that permits a camper or other user to position a jet flame at any angle during use, even in windy conditions.

Generally, wherein like numbers describe like parts, FIGS. 1-7 illustrate a torch 10 that includes a fuel delivery system, an ignition system, and an interlock mechanism. In one particular aspect of the invention, the interlock mechanism prevents the ignition system from igniting fuel delivered from the fuel system, while preventing the delivery of fuel through the fuel system to one or more microjet burners. More specifically, the interlock system is a physical mechanism that prevents an ignition button from opening a fuel discharge valve that allows gas to flow, and ensuring that the ignition button does not actuate a piezoelectric ignitor (not shown, though disposed as known conventionally below the ignition button 22) that generates a spark that can ignite the fuel. The interlock mechanism is enclosed within a covering or housing to protect the mechanism from outside elements, whereby the functionality of the interlock mechanism is not discernable to the user, and invisible to the user experience.

Figure 1:
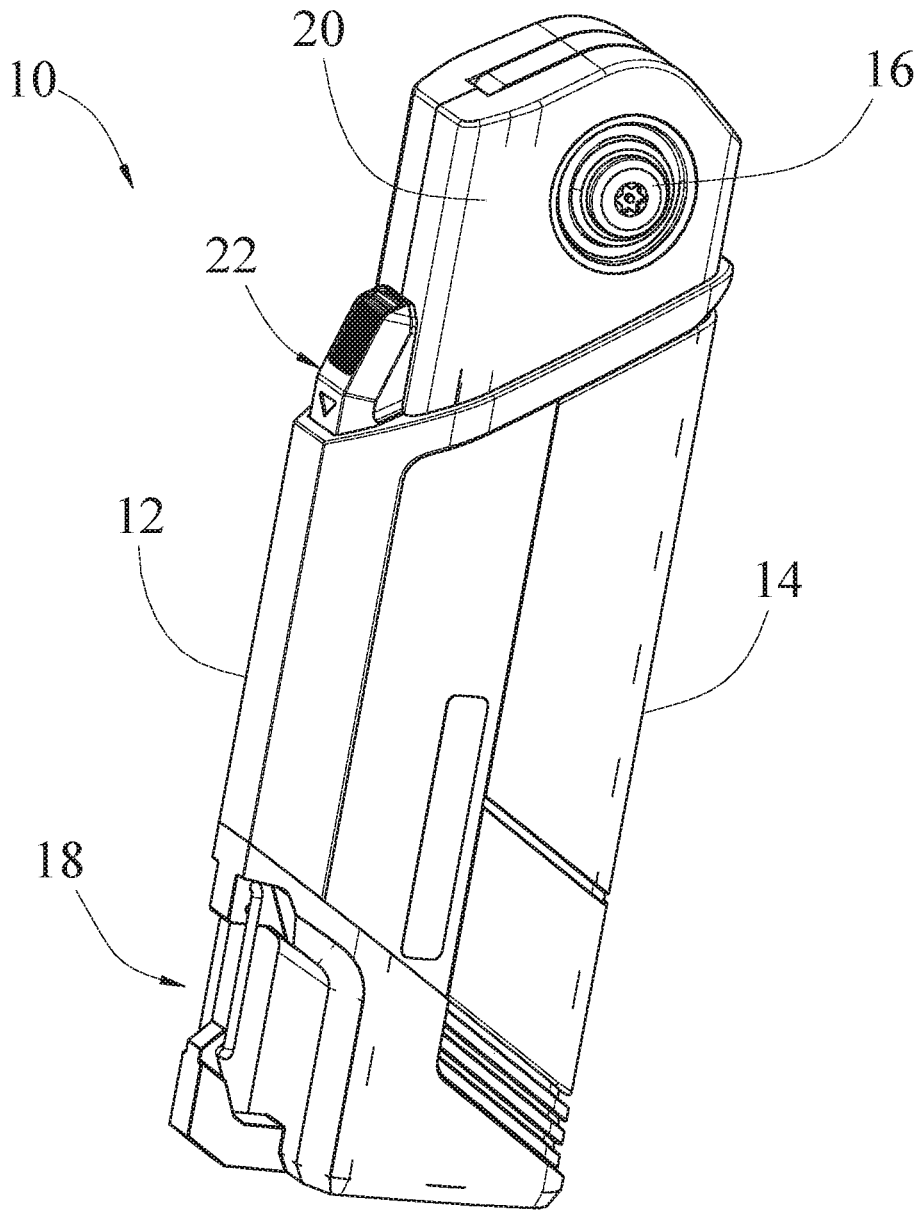
FIG. 1 is a perspective view of a torch in a closed position according to the invention.

Referring more specifically to FIG. 1, a perspective view of a torch 10 in a closed position is shown in accordance with the invention. Torch 10 generally includes a torch body 12 and a torch arm 14. Torch arm 14 is attached to torch body 12 with a bolt 16 defining a pivot axis 200 so that torch arm 14 may articulate or be pivoted to some angle relative to torch body 12. Again, as illustrated in FIG. 1, torch 10 is closed whereby torch body 12 and the torch arm 14 are in a generally side-by-side and parallel arrangement. As will be referred to and further described hereinafter, torch 10 is said to be in the closed or 0 degree position.

Still referring to FIG. 1, torch 10 may optionally include carabiner clip 18 for added user convenience and portability. Torch 10 may also include a removable outer portion(s) or cover(s) 20. Cover(s) 20 functions to enclose, house and protect the interlock mechanism of torch 10 as will be shown in later figures and gives torch 10 a sleeker, more uniform appearance.

Torch body 12 of torch 10 houses an ignition button 22. In use, ignition button 22 is pressed by a user to ignite torch 10. However, in the closed position or 0 degree position and as shown in FIG. 1, a user is prevented from pressing, under a force of a finger or thumb, the ignition button 22 to travel in a generally downward motion along the length of the torch body 12, to an ignition position for energizing a piezoelectric ignitor, and causing an associated fuel-flow actuator lever from opening a fuel discharge valve in fluid communication with a fuel tank, as will be described in more detail hereinafter.

Figure 2:
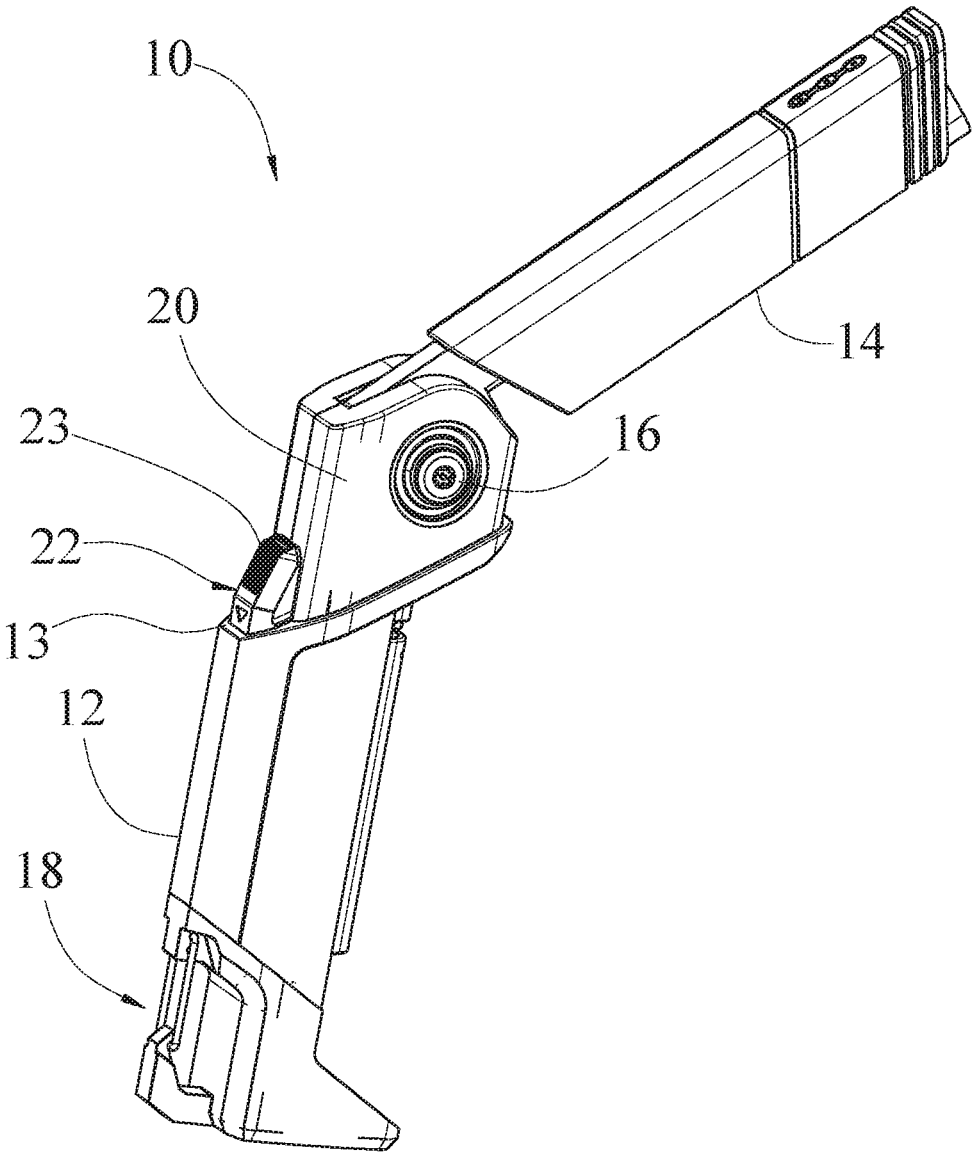
FIG. 2 is a perspective view of the torch shown in FIG. 1 in an open position, ready for operation.

Referring now to FIG. 2, a perspective view of torch 10 is shown in an open position, ready for operation. In the open position, torch arm 14 has been pivoted from its closed position in FIG. 1, to an open position with an angle between the torch body 12 and the torch arm 14 of about 135 degrees. In one embodiment, it will be appreciated that in an open position, the angle between torch body 12 and torch arm 14 can be greater than 90 degrees and up to 180 degrees, provided there is room sufficient for a user to grasp and hold the body 12 of the torch 10. More typically, the angle between torch body 12 and torch arm 14 can be conveniently anywhere between 90 degrees and 180 degrees. In another embodiment, the angle between torch body 12 and torch aim 14 can exceed 180 degrees.

Further, when torch 10 is opened to an armed position, a user is able to depress the ignition button 22 to travel to a strike position at which either or both the piezoelectric ignitor is energized, and the fuel discharge valve is opened, as will be described in more detail hereinafter.

Ignition button 22 can be a conventional device and includes a thumb (or finger) pad 23 and means for engaging a plunger of the piezoelectric ignitor, and for engaging the fuel-flow actuator lever. The ignition button 22 can be movable axially upward and downward, relative to and along the outside surface of the body, along a stroke length between the raised neutral position shown in FIGS. 1, 2 and 4, where the thumb pad 23 is spaced from a shoulder 13 of the body 12, and the depressed, strike position, shown in FIG. 5, where the thumb pad 23 is pressed and stopped against or proximate to the shoulder 13. When ignition button 22 is pushed downwardly toward the depressed strike position, ignition button 22 engages and begins forcing downwardly the plunger of the piezoelectric ignitor, and engages the fuel-flow actuator lever and begins actuating the fuel discharge valve 43. When ignition button 22 reaches the depressed strike position, the plunger causes a strike that activates the piezoelectric igniter and generates a spark at ignition wire 36 proximate the microjet torches 30, 32, 34, shown in FIG. 3.

Figure 3:
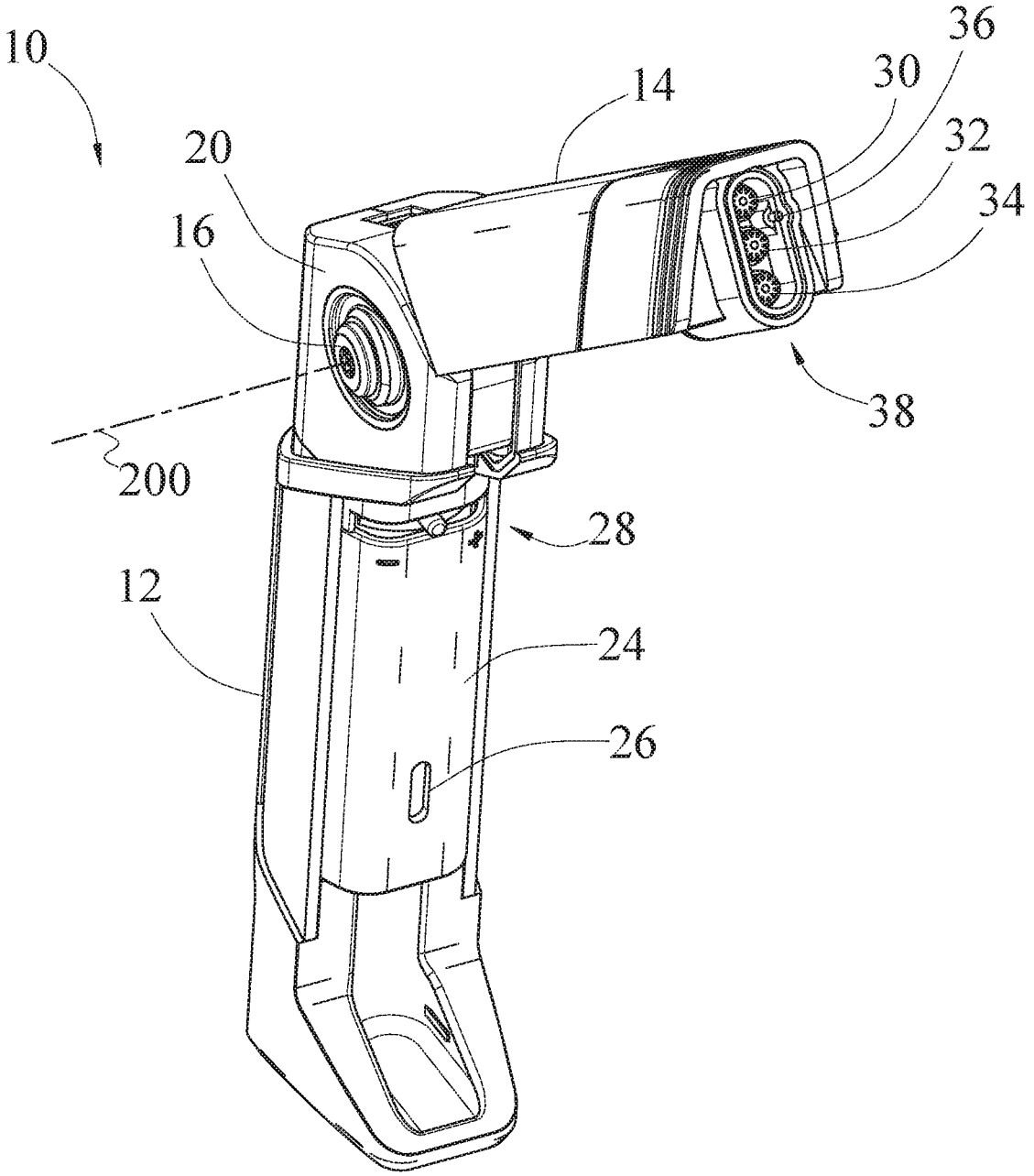
FIG. 3 is an alternative perspective view of the torch shown in FIG. 2.

Further referring to FIG. 3, an alternative perspective view to FIG. 2, the torch body 12 houses a fuel tank 24. Torch body 12 can be made as a unitary structure such that fuel tank 24 can be slidingly and frictionally engaged within torch body 12 during assembly and disassembly of torch 10. When torch 10 is configured for use, fuel tank 24 contains a hydrocarbon fuel, e.g., butane.

Fuel tank 24 can have an aperture that defines a fuel window 26, for example, an elongated or oval-shaped aperture, along a side wall of the fuel tank 24, to facilitate observing and determining the amount of fuel remaining within fuel tank 24. Fuel tank 24 can also include a polished, reflective interior surface (not shown) within, which can facilitate observing the fuel level through a translucent material of the fuel tank 24. In one embodiment, fuel tank 24 can be made of a translucent or transparent material such as a fuel-inert plastic, e.g., nylon, and even glass. Illustrated in FIG. 6, torch body 12 further includes a valve throttle lever 28 that is engaged with a fuel discharge valve 43 that allows a user to control the amount and/or rate of fuel that is expelled from fuel tank 24.

Torch arm 14 has a distal end 38 that houses three microjet burners 30, 32, 34 and a piezoelectric wire 36. It will be appreciated that piezoelectric wire 36 must be located proximate the three microjet burners 30, 32, 34 so that a spark emitted from the piezoelectric wire 36 is able to ignite a gas escaping from one or more of the three microjet burners 30, 32, 34. Thus, in the embodiment shown and described, torch arm 14 of torch 10 includes three microjet burners 30, 32, 34. However, it will be appreciated that other embodiments may include as few as one microjet burner, while others still, may include some other number. None of these embodiments depart from the spirit of the invention and the number of microjet burners may be adjusted as desired by one of ordinary skill in the art.

Figure 4:
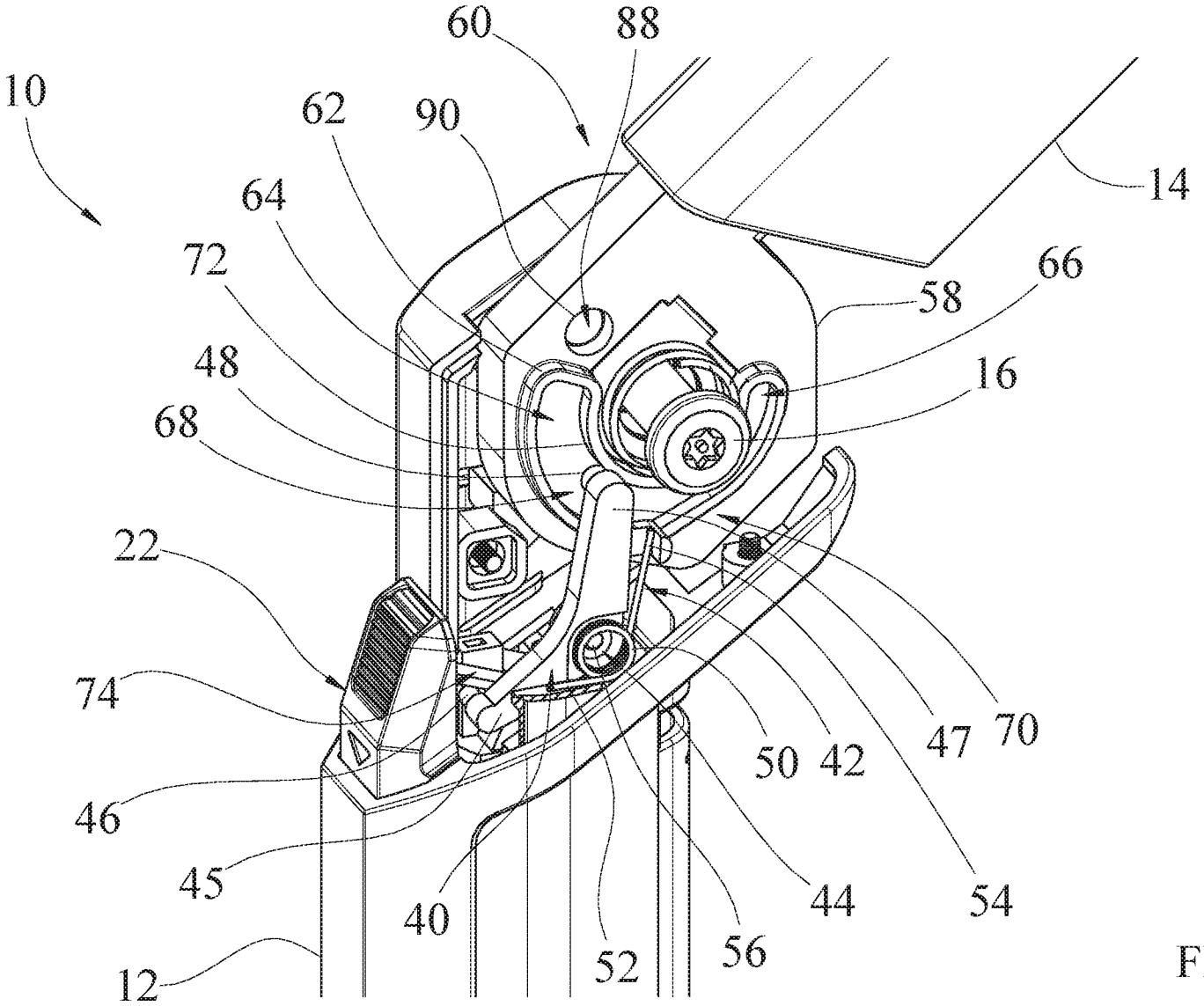
FIG. 4 is a partial perspective view of the torch as shown in FIG. 2.
Figure 5:
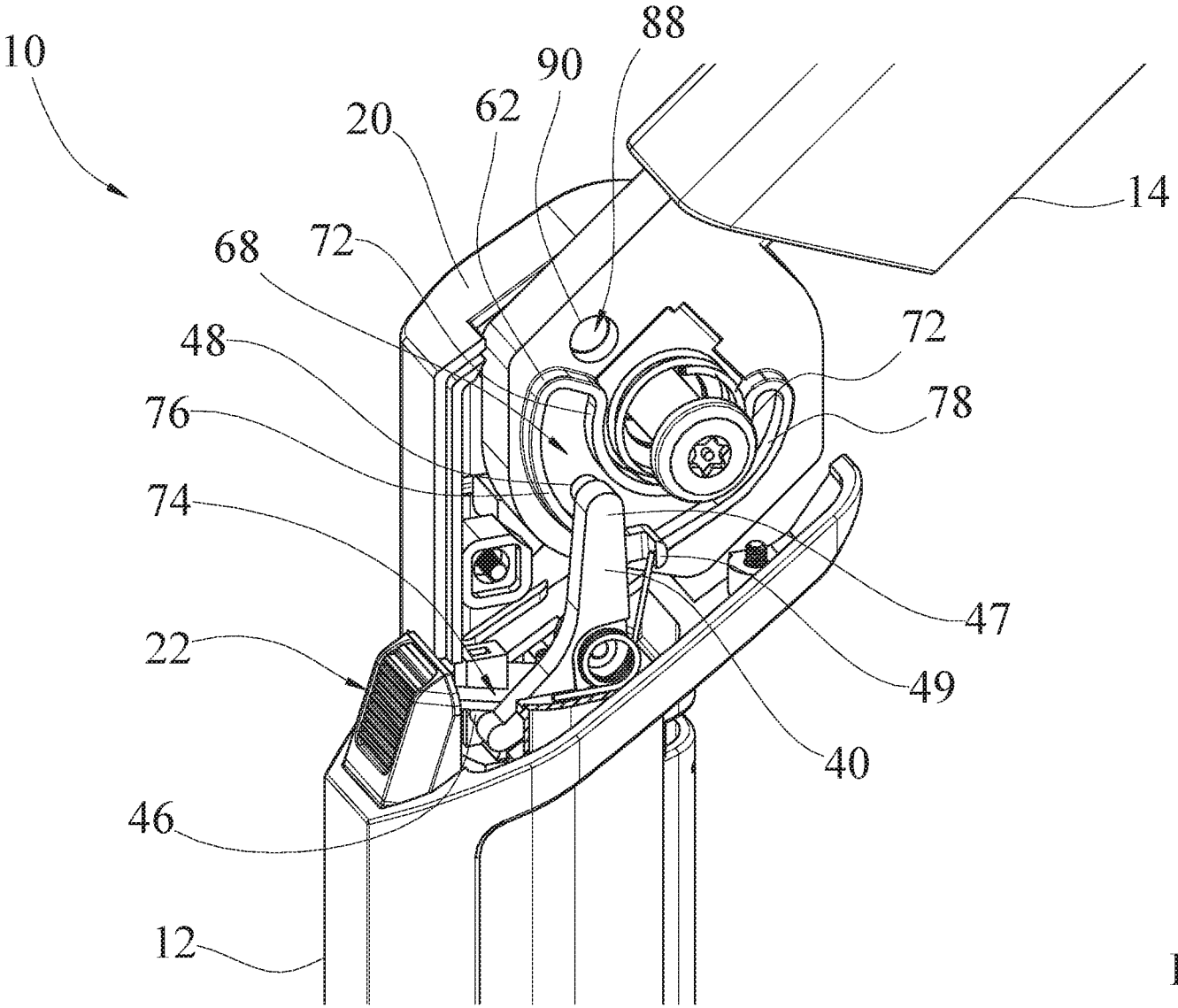
FIG. 5 is also a partial perspective view of the torch as shown in FIG. 2 but with an ignition button depressed.
Figure 6:
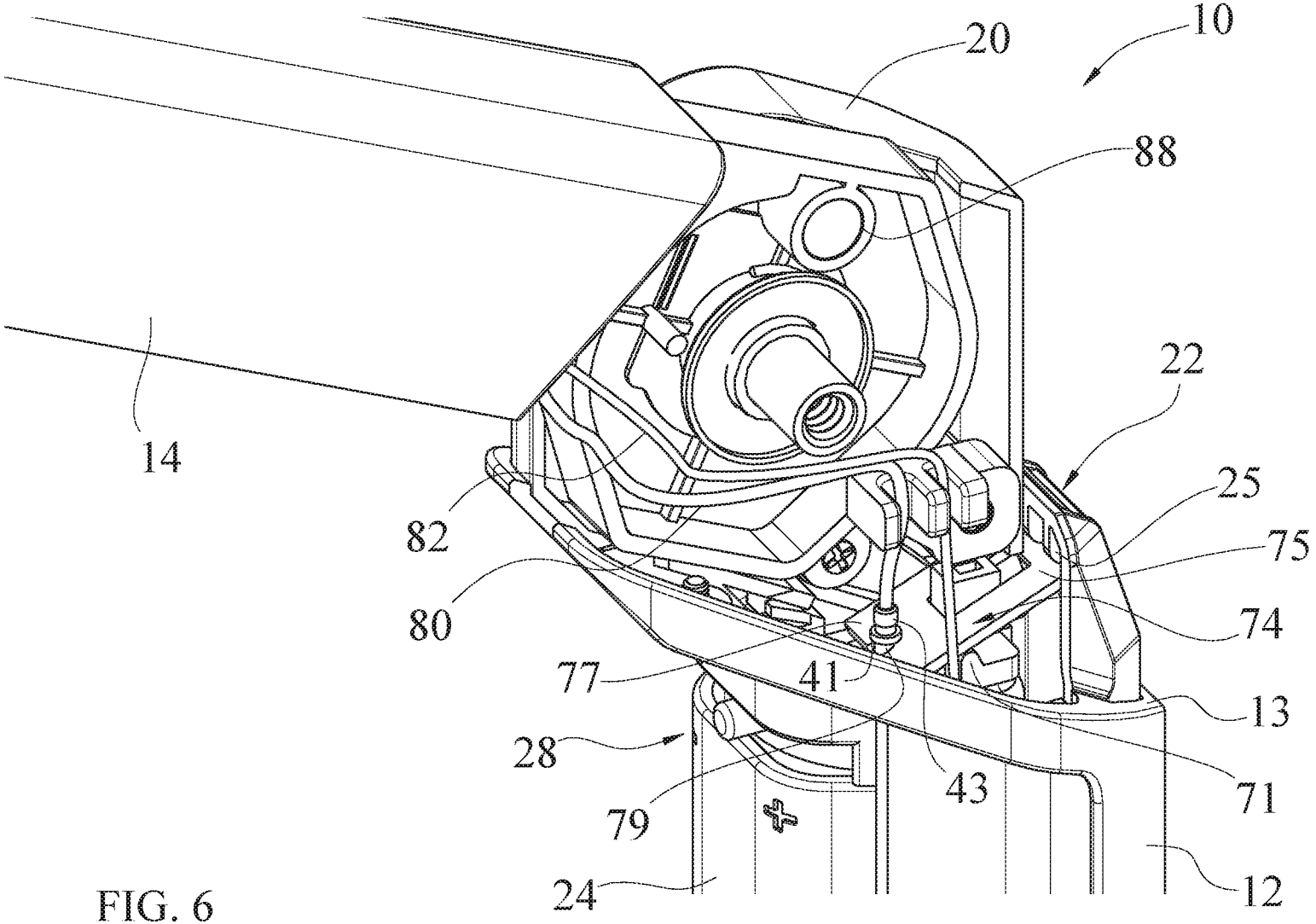
FIG. 6 is also a partial perspective view of the torch as shown in FIG. 2 but from a reverse angle.

Referring now to FIGS. 4 and 6, where FIG. 4 illustrates a partial perspective view of torch 10 shown in FIG. 2 with front cover 20 removed, and FIG. 6 illustrates a reverse angle of FIG. 5 with back cover 20 removed. Again, in FIGS. 4 and 6, ignition button 22 has not been pressed. Further, with front cover 20 removed and as shown, torch body 12 is configured to receive a rocker arm 40 and an associated retaining spring 42. Rocker arm 40 has a central mounting pivot point 44 and opposing end arms 45,47, each end arm 45,47, including respectively a cylindrical boss 46,48 that extend laterally from the opposing end arms 45,47 of the rocker arm 40. A retaining spring 42 has a central helical portion 50 and spring arms 52, 54. Rocker arm 40 and retaining spring 42 are attached to torch body 12 with a shoulder bolt 56.

As also advantageously shown, torch arm 14 includes a mounting tab 58 disposed at a proximal end 60. Formed in mounting tab 58, such as through molding or machining, is wall 62 defining a groove or pocket 64. More specifically, pocket 64 has an inner radial portion or pathway 66 disposed from the pivot axis defined by bolt 16, and an outer radial portion or pathway 68, concentric with the inner radial portion or pathway 66. The inner and outer radial pathways allow pocket 64 to control the functionality of torch 10 based on the angular position of torch aim 14 relative to torch body 12.

When assembled, the distal boss 48 of rocker arm 40 is retained within pocket 64 at least partially by a wall 62, and is prevented from movement radially inwardly from the inner radial pathway 66 by an inner radial wall portion 72. The distal spring arm 54 of the retaining spring 42 is installed to functionally bias against a shoulder 49 extending from the distal end arm 47, thereby biasing the distal boss 48 radially inwardly (clockwise) against the inner radial wall portion 72. As shown in FIG. 6, the proximal boss 46 located at the proximal end arm 45 of rocker aim 40, is disposed against an underside of a distal end 75 of the fuel-flow actuator lever 74, which extends under an internal shoulder 25 of the ignition button 22. It can be understood that the biasing force of the distal spring arm 54 of the retaining spring 42 also biases the proximal boss 46 upwardly (clockwise) against the underside of the distal end 75 of the fuel-flow actuator lever 74, thereby biasing the internal shoulder 25 and the ignition button 22 upwardly toward its raised neutral position.

As illustrated in FIG. 6, the fuel-flow actuator lever 74 also includes a proximal end 77 having a notch 79 formed into the distal edge. The body of the torch also includes a fulcrum 71, with an intermediate portion of the fuel-flow actuator lever 74 positioned on top of the fulcrum 71, acting as a pivot for raising and lowering the proximal end 77 and distal end 75 of the fuel-flow actuator lever 74. The notch 79 is configured to extend into and under an annular groove 41 in the stem of the fuel discharge valve 43, which is biased downwardly to a closed position by an internal mechanism (not shown). Raising of the proximal end 77 of the fuel-flow actuator lever 74 correspondingly raises the stem of the fuel discharge valve 43 against the bias, to open fuel flow of fuel discharge valve 43. When the force to raise the proximal end 77 of the fuel-flow actuator lever 74 is released, the bias of the fuel discharge valve 43 shuts off fuel flow.

Figure 7:
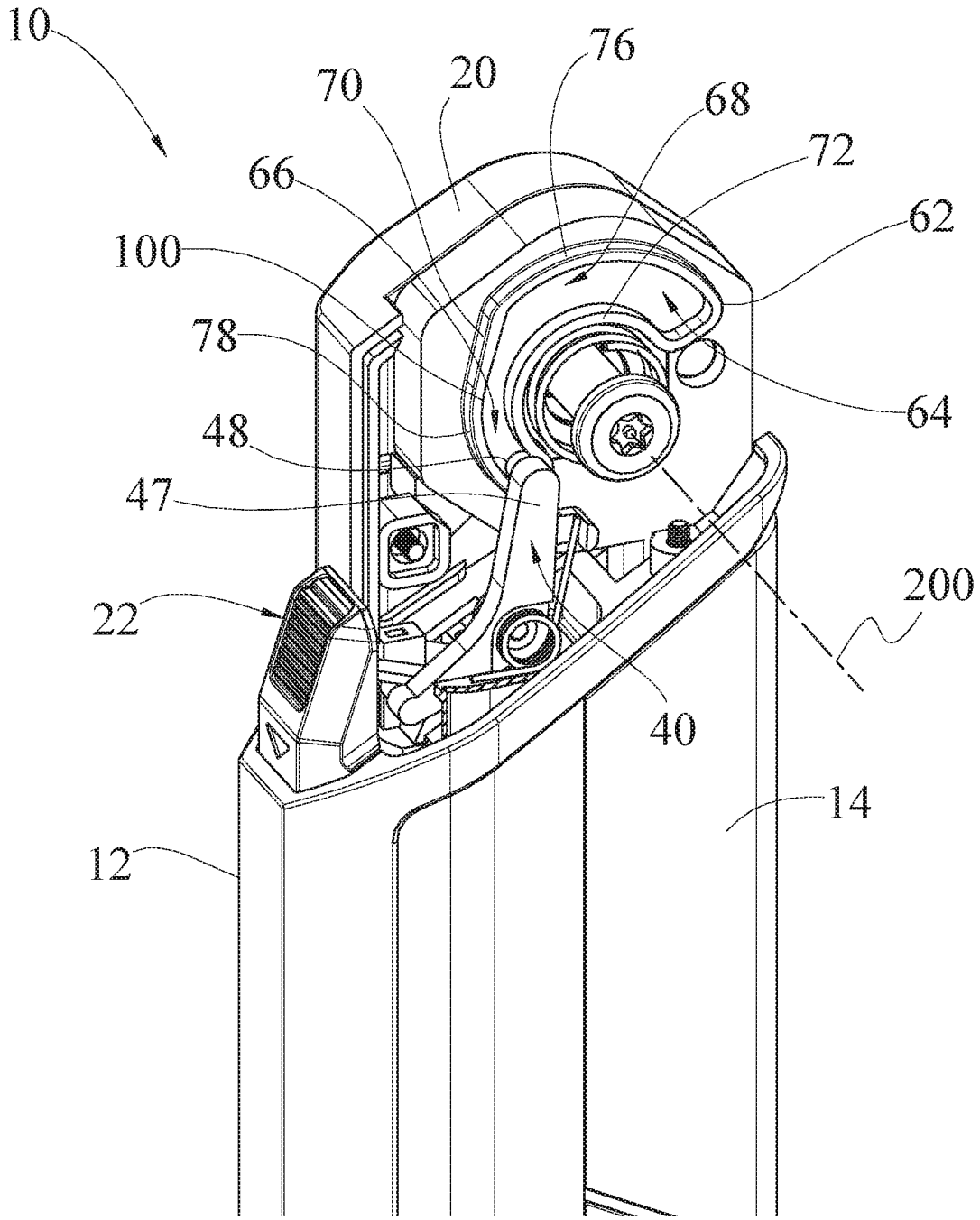
FIG. 7 is a perspective view of the torch shown in FIG. 1 with a cover removed.

Referring now to FIG. 7, torch 10 is shown as in FIG. 1 but with a front cover 20 removed. In the closed position of the torch 10, the distal boss 48 of the rocker arm 40 is disposed in the inner radial pathway 66, confined from movement radially inwardly by the inner radial wall portion 72, and from movement radially outwardly by a first outer radial wall portion 78. The first outer radial wall portion 78 can extend circumferentially along the pocket 64, defined by an angular length that defines a protection angle of the torch arm 14 from the closed position (0 degree position) at which the distal boss 48 of the rocker arm 40 remains confined from movement radially outwardly by the first outer radial wall portion 78. It can be understood that confinement of the distal boss 48 of the rocker arm 40 from movement radially outwardly prevents pivoting of the rocker arm 40 in the counterclockwise direction. This in turn maintains the biasing force of the proximal boss 46 upwardly on the distal end of the flow actuator lever 74, thereby resisting and preventing depressing of the ignition button 22 from the raised neutral position toward the depressed, strike position, and raising of the fuel discharge valve 43, which prevents the flow of fuel and the striking of an ignition spark. Were the ignition button 22 pressed by a user, the second outer radial wall portion 78 confines the boss 48 and prevents its radially outward movement, thereby preventing rocker arm 40 from pivoting counterclockwise and consequently preventing ignition button 22 from traveling downward to a depressed position, and in effect "locking-out" ignition button 22 and inhibiting its depressing. Thus, pocket 64 and rocker arm 40 define an interlock mechanism wherein the relative shape of pocket 64 through the extent and position of first and second outer radial pathway portions 76, 78 define angular pivoting ranges of the torch arm 12 for both protected and ignition use for torch 10.

As shown in FIGS. 5 and 7, the first outer radial wall portion 78 at angular position 100 begins to extend along an outer transition wall portion 70 radially outwardly to a second outer radial wall portion 76 that is disposed a greater distance radially from the pivot axis 200 than the first outer radial wall portion 78. The outer transition wall portion 70 and the second outer radial wall portion 76 define the outer radial pathway 68 of the pocket 64 into which the distal boss 48 may move in response to the depressing of the ignition button 22 toward and to its depressed, strike position.

After the torch arm 12 has been rotated to an angle greater than the protection angle, the distal boss 46 of the rocker arm 40 pivotally aligned with the outer radial pathway 68 of the pocket 64, into which it can be moved. Within the angular rotation range of the torch arm 12 at which the distal boss 46 of the rocker aim 40 pivotally aligned with the outer transition wall portion 70, the movement of the boss 48 outwardly may be confined by the outer transition wall portion 70 to only a limited portion of the stroke length of the ignition button 22, at which fuel may or may not begin to flow, but at which the piezoelectric ignitor is not energized. At greater rotation of the torch arm 12 to an ignition or armed angle, the distal boss 46 of the rocker arm 40 will be unconfined by the outer transition wall portion 70 and second outer radial wall portion 76. Without the confinement of the distal boss by the first outer radial wall portion 78, the depressing of the ignition button 22 in turn lowers the distal end 75 of the fuel-flow actuator lever 74, and pivots and raising the proximal end 77 of the fuel-flow actuator lever 74, and opens the fuel discharge valve 43. The depressing of the ignition button 22 also energizes the piezoelectric ignitor, which strikes a spark to ignite the fuel.

It will be appreciated that at any time the ignition button 22 is undepressed, and at its raised neutral position, the rocker atm 40 and the distal boss 46 will be biased clockwise by the spring 42, and that the distal boss 48 will pivot radially inwardly to engage against the inner transition wall portion 72, regardless of the pivot angle of the torch arm 12. With the ignition button 12 depressed and the torch arm 12 opened into the armed position, the distal boss 48 is pivoted radially outward into the outer radial pathway 68 of pocket 64. It can be understood that the outer transition wall portion 70 provides a means for biasing and returning the distal boss 48 back toward the inner radial pathway 66 in the accidental or inadvertent situation where the user attempts to close the torch atm 12 while also depressing the ignition button 22, thereby easing the transition between the operational state and locked-out state of torch 10.

Referring now to FIG. 5, with torch arm 14 rotated to between 90 degrees and 180 degrees relative to torch body 12, the torch 10 is in a configuration in which the ignition button 22 may be depressed and, in fact is now shown in that position. This functionally causes two aspects of the invention to occur. First, ignition button 22 presses down on the proximal end of the flow actuator lever 74, which correspondingly pushes down (counterclockwise) against proximal boss 46 of rocker arm 40. This in turn biases rocker arm 40 to pivot counterclockwise, and in the illustrated embodiment, the rocker arm 40 moves to pivot counterclockwise. It will be appreciated that it is possible for this to occur because distal boss 48 is biased to move radially away from the inner radial pathway 66, and toward or into the outer radial pathway 68 of pocket 64, due to the angular position of the mounting tab 58 and torch arm 14, to torch body 12 and the position of the distal boss 48. Further, and as will also be appreciated, distal boss 48 has been moved radially away from the inner radial wall portion 72, and may now ride against a first outer radial portion 76 of wall 62. Moreover, ignition button 22 is now able to energize piezoelectric igniter 36. Second, lever 74 has simultaneously enabled fluid communication between fuel tank 24 and microjet burners 30, 32, 34.

FIG. 6 shows the reverse angle of FIG. 5 with back cover 20 removed and the front cover 20 installed, and illustrates the fuel hose 80 and ignition wire 82. At one end, fuel hose 80 is connected to the fuel discharge valve 43, and is thus, in fluid communication with fuel tank 24. The other end of fuel hose 80 is connected to the microjet burners 30, 32, 34, whereby the fuel tank 24 is in selective fluid communication with microjet burners 30, 32, 34. Ignition wire 82 extends from the discharge end of the piezoelectric igniter 36 (not shown) to the piezoelectric wire 36, shown in FIG. 3. A retaining member 84 including a plurality of fingers defining a pair of guide channels, retains portions of the fuel hose 80 and ignition wire 82, and restraining and guiding the fuel hose 80 and ignition wire 82 through and past the elements of the interlock system, to prevent them from becoming tangled, kinked or pinched when torch arm 14 is pivoted relative to torch body 12.

Referring briefly to FIGS. 4-6, mounting tab 58 has a plurality of socket apertures 88 formed in the mounting tab 58 at a radius from the pivot axis 200, and configured to receive a spring-loaded detent ball 90 disposed in the torch body 12. As is be appreciated, any number of ball detents may be arranged in torch body 12, so as to define a plurality angular positions of the torch arm 14 relative to torch body 12, at which the torch body will temporarily arrest pivoting of the torch arm. Non-limiting examples of angular positions at which the torch arm may rotate to a detent, include 90, 120, 135 and 180 degrees.

Once the user has finished using the torch for igniting a flame, the flame can be extinguished by releasing the ignition button 22, which results in the distal boss 48 biasing back, radially inwardly, into contact with the inner radial wall 72.

While various embodiments of a torch have been illustrated by the foregoing Figures and have been described in considerable detail, it is not intended to restrict or in any way limit the scope of the appended claims to such detail. Additional advantages and modifications will be readily apparent to those skilled in the art.

What is claimed is:

1. A torch device having a body and including:

a fuel delivery system including a fuel tank including a fuel discharge valve, one or more microjet burners, a fuel hose placing the fuel discharge valve in fluid communication with the one or more microjet burners, and flow actuator lever movable between a first position and a second position at which fuel discharge valve is opened;

an ignition system including an ignition button, a piezoelectric igniter, and an ignition wire, the ignition button configured to move between an raised, undepressed position to a second depressed position at which the ignition button mechanically engages and energizes the piezoelectric igniter and to emit a spark at the ignition wire, and wherein the flow actuator lever in the first position biases the ignition button to its raised, undepressed position;

a torch arm having a distal end housing the piezoelectric igniter and the one or more microjet burners, and having a proximal end including a mounting tab having a planar base wall defining a pocket, the mounting tab pivotally attaching the torch arm to the torch body to define a torch arm pivoting angle, wherein the pocket includes a pathway defined by a radial inner wall and a radial outer wall; and an interlock mechanism comprises a rocker arm pivotally fixed to the body, the rocker arm having a distal arm confined and pivotable within the pocket between a first closed position and a second armed position;

wherein the pathway includes a first radial pathway within which the distal rocker arm is confined while the torch atm is pivoted from the closed position through a protection angle, wherein the first radial pathway includes the radial inner wall and a first portion of the radial outer wall, and wherein the first portion of the radial outer wall constrains the distal rocker arm prevents the distal rocker arm from pivoting from its first closed position, and thereby restrains and prevents depressing of the ignition button from the raised, undepressed position;

wherein the pathway includes a second radial pathway within which the distal rocker arm is confined while the torch arm is pivoted beyond the protection angle through an armed angle, wherein the second radial pathway includes the radial inner wall and does not include a portion of the radial outer wall, and wherein the distal rocker arm is not prevented from pivoting from its first closed position to a second armed position, wherein with the torch arm within the armed angle, depressing of the ignition button to a second depressed position ignites the torch.

2. The torch device according to claim 1, wherein the body and the mounting tab have a plurality of detents at which the torch body will temporarily arrest pivoting of the torch arm.

3. The torch device according to claim 1, wherein the angular positions between 0 and 90 degrees defines a closed and locked out position.

4. The torch device according to claim 1, wherein the angular positions between 90 and 180 degrees defines an armed and operational position.

5. The torch device according to claim 1, wherein the protection angle of the torch aim from closed is about 90 degrees.

6. The torch device according to claim 1, wherein the armed angle of the torch awl extends to about 180 degrees.

7. A torch device including:

a fuel delivery system including a fuel tank, a fuel hose, and one or more microjet burners, the fuel tank in fluid communication the one or more microjet burners via the fuel hose;

an ignition system including an ignition button, an ignition wire, and a piezoelectric igniter, the ignition button electrically connected to the piezoelectric igniter via the ignition wire and configured to control the flow of fluid from the fuel tank to the one or more microjet burners;

a interlock mechanism including a pocket and a lever;

a torch body housing the fuel tank and the ignition button and further configured for the mounting of the lever;

a torch arm housing the piezoelectric igniter and the one or more microjet burners in a proximate manner at a distal end and having a mounting tab having a wall defining the pocket at a proximal end, the torch arm attached to the torch body using the mounting tab;

wherein the pocket, via the lever, prevents a user from pressing the ignition button based on the angular position of the torch arm relative to the torch body.

8. A torch device having a pivoting torch arm, including a fuel delivery system having a fuel tank and microjet burners positioned in the end of the torch arm, and an ignition system including an ignition button and a piezoelectric igniter for igniting fuel, and an interlock mechanism including a mounting tab pivotally attaching the torch arm to the body of the torch, with a guide pocket defined by a laterally-extending wall of the mounting tab, and a rocker arm having a distal arm cooperating with and confined within the guide pocket, and a proximal arm cooperating with the ignition button, and configured to prevent a user from pressing the ignition button based on the angular position of the torch arm relative to the torch body.

* * * * *